US006337143B1

(12) United States Patent
Ragland et al.

(10) Patent No.: US 6,337,143 B1
(45) Date of Patent: Jan. 8, 2002

(54) APPLIANCE INSULATED WITH PROTECTED FIBER INSULATION

(75) Inventors: G. William Ragland, Dunwoody, GA (US); Stephen J. Fairchild, Pittsboro, NC (US)

(73) Assignee: ATD Corporation, Suwanee, GA (US)

( * ) Notice: Subject to any disclaimer, the term of this patent is extended or adjusted under 35 U.S.C. 154(b) by 0 days.

(21) Appl. No.: 09/570,398

(22) Filed: May 12, 2000

(51) Int. Cl.[7] ..... B32B 15/00

(52) U.S. Cl. ..... 428/594; 428/604; 428/302; 428/213; 428/292.1; 156/296

(58) Field of Search ..... 428/594, 603, 428/604, 286, 302, 920, 213, 75, 292.1; 156/296

(56) References Cited

U.S. PATENT DOCUMENTS 5,658,634 A 8/1997 Ragland et al. ..... 428/75
5,658,638 A * 8/1997 Ragland et al. ..... 428/75
5,939,212 A 8/1999 Ragland et al. ..... 428/594
5,958,603 A 9/1999 Ragland et al. ..... 428/595

* cited by examiner

*Primary Examiner*—Merrick Dixon
(74) *Attorney, Agent, or Firm*—Burns, Doane, Swecker & Mathis, LLP

(57) ABSTRACT

An insulated appliance which provides a simple, low cost product and method for containing fiber insulation for application to appliances. A combination of an appliance, fiber insulation layer applied to the exterior surface of a wall of the appliance and a multilayer metal foil adhesively bonded to the outside of the fiber layer. This combination is conveniently formed by adhesively bonding the fiber layer to the multilayer metal foil, then applying the fiber layer to the exterior surface of the wall of the appliance. In the appliance final assembly, the fiber layer is contained between the surface of the wall of the appliance and the multilayer metal foil. Optionally, the fiber is contained between two or more layers of multilayer metal foil, whereby one of the multilayer metal foil is in contact with the wall of the appliance.

10 Claims, 1 Drawing Sheet

APPLIANCE INSULATED WITH PROTECTED FIBER INSULATION

This invention relates to appliances, such as ovens, dishwashers, refrigerators and stoves, which are insulated with fiber mat or fibrous insulation.

BACKGROUND OF THE INVENTION

A conventional insulation for appliances is fiber insulation, such as fiberglass, polymeric fibers or cellulose fibers. Various problems are associated with the conventional use of such fiber insulation. The fibers are usually provided in the form of mats or batts, which are cut and shaped at the site of assembly of the appliance and taped or plastic film wrapped in place on the appliance. The fiber mats or batts frequently lack dimensional stability and will stretch or tear during installation on the appliance. The loose fibers, which are dislodged from the mats and batts during handling and assembly on the appliance, pose a worker risk ranging from skin irritation to significant health problems, especially with fiberglass insulation.

Various methods have been used to avoid or solve the above problems. Fiber mats and batts have been encapsulated in plastic film bags or pillows. The fiber has been impregnated with binder or resin to form a unitary mass of fiber to prevent loss of individual fibers. However, these method have disadvantages which make them undesirable to use because of loss of insulating value of the mat or batt, or ineffectiveness in actually solving the problem.

There is a need for an efficient, cost effective way to contain fiber insulation in appliance applications.

SUMMARY OF THE INVENTION

This invention provides a simple, low cost way of containing fiber insulation for application to appliances. Consequently, this invention provides a combination of an appliance, fiber insulation layer applied to the exterior surface of a wall of the appliance and a metal foil layer adhesively bonded to the outside of the fiber layer. This combination is conveniently formed by adhesively bonding the fiber layer to the metal foil, then applying the fiber layer to the exterior surface of the wall of the appliance such that in the final assembly the fiber layer is contained between the surface of the wall of the appliance and the metal foil layer. The metal foil layer with the fiber layer adhesively bonded to it, provides a dimensionally stable insulating material that can be cut to shape or pre-cut in a controlled environment to the desired shape and size for a particular appliance application.

In another aspect this invention optionally provides the above combination and assembly, but with additional layers of metal foils and/or additional layer of fiber insulation. Depending on the particular application and insulation value needed in a particular appliance, the fiber layer may have a metal foil layer adhesively bonded to both sides of the fiber layer. In this embodiment, one metal foil layer on one side of the fiber layer is positioned on the surface of the wall of the appliance and the other metal foil layer is adhesively bonded to the other side of the fiber layer. This embodiment provides a means to enclose the fiber insulation between the metal foil layers before assembly on the appliance.

DESCRIPTION OF THE INVENTION

Figure 1:
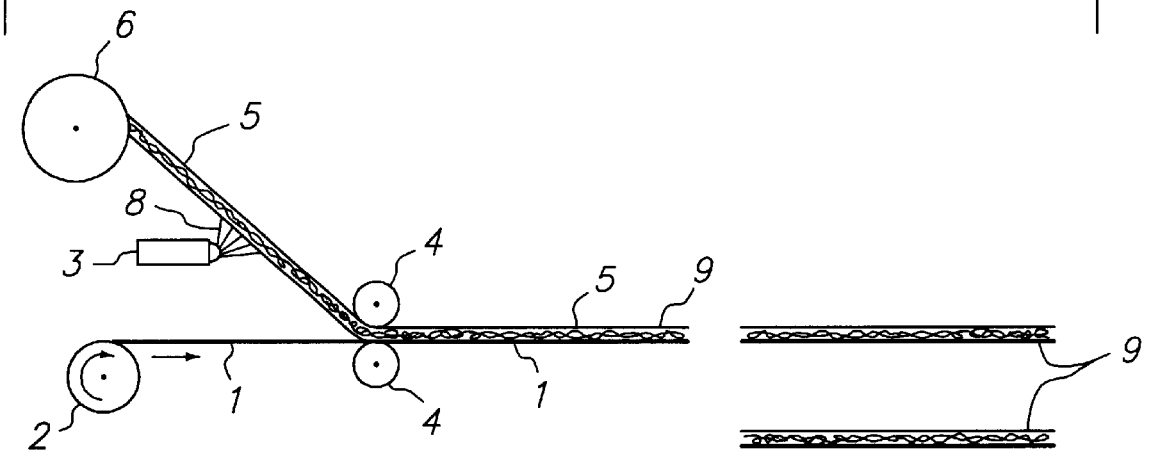
FIG. 1 is an illustration of making the fiber adhesively bonded to a metal foil.
Figure 2:
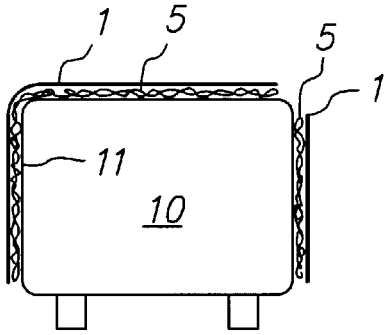
FIG. 2 is a cross section illustration of the fiber-metal foil insulation positioned on the outside surface of a wall of and oven.

This invention can best be understood by reference to FIGS. 1 and 2, which illustrate a basic form of the insulation of this invention and the insulated appliance of this invention. Metal foil layer 1 is fed from metal foil roll 2. Fiber insulation mat 5 is fed from roll 6 past liquid adhesive spray bar 3 where adhesive 8 is sprayed on the fiber insulation mat. Metal foil layer 1 and fiber insulation mat 5 are fed between rollers 4 to press the fiber wet with adhesive to the metal foil layer 1 to bond the two together to form the insulation product 9 comprising the metal foil layer 1 bonded to the fiber insulation layer 5. Product 9 can be cut into desired lengths or shapes, as shown in FIG. 1, to facilitate placing them on appliance walls.

FIG. 2 is an illustration of an oven appliance 10 with the product 9 from FIG. 1 places on three side walls so that the fiber insulation mat 5 is in contact with the wall outside surface and metal foil layer 1 is on the outside of the fiber insulation mat 5. While FIG. 2 illustrates the product 9 places on oven appliance 10 in three sections, it will be apparent that product 9 can be made and cut to size such that one length or piece of product 9 would cover all three sides of the oven appliance 10. Similarly, it will be apparent that product 9 may have a second metal foil layer bonded to the other side of fiber insulation mat 5, then applied to the wall of the oven appliance 10 as shown in FIG. 2.

The bonding of the insulation layer to the metal foil layer may be accomplished by any means desirable for the end use application on product 9 and the thermal and strength properties needed for a particular application. The adhesive may be liquid spray, film or powder. It may be thermoset or thermoplastic, as desired for performance and cost. Examples of adhesive for bonding fiber insulation mats or batts to metal foil are disclosed in U.S. Pat. No. 5,658,634 the disclosure of which is incorporated herein by reference in its entirety.

The bonded fiber mat and metal foil can be formed and shaped in any desired manner before or during installation on an appliance wall. For example, the edge of the fiber-foil product can be rolled similar to that in U.S. Pat. No. 5,958,603 the disclosure of which is incorporated herein by reference in its entirety. This type of edge treatment may be particularly desirable then two or more foil layers are used and the fiber can be contained in a sealed compartment between foil layers. Other treatment of the metal foil layer before or after the fiber layer is bonded to it may be selected by one skilled in the art, such as corrugations shown in U.S. Pat. No. 5,939,212 the disclosure of which is incorporated herein by reference in its entirety.

The type and thickness of the metal foil or sheet layer used in this invention will likewise depend on the performance desired and can be selected by one skilled in the art. For example, the metal foils and sheets disclosed in the above referenced patents are useful in this invention, as well as those disclosed in U.S. Pat. No. 6,222,160, the disclosure of which is incorporated herein by reference in its entirety. The metal foils employed in this invention are preferably aluminum, because of low cost, good performance and ease of assembly, but other metals may be used, such as copper and stainless steel foils. While foils are preferred in this invention, thicker metal components may be used, such as metal sheets or plates. Foils are preferred for cost, weight and assembly reasons which are obvious. Metal sheets of greater than 6 mils may be used where a more rigid container structure is desired. The foils are generally 1 to 5 mils (1 mil=0.001 in.) in thickness for use in this invention. Preferably the foil layers facing the fiber will be 3 to 5 mils, with about 3 mils preferred for most ordinary applications. The interior foil layers between the fiber and the appliance wall are generally 0.8 to 5 mils in thickness, with about 2 mils preferred for most ordinary applications. The foil layers can be metalized plastic foil or film. It is preferred that the foil layer or layers adjacent the appliance be metal foil or sheet layers to provide sufficient spreading of the heat from the appliance, whereas metalized film may be used as other foil layer on the outside of the fiber. The foil layers can be single or multiple layers, smooth, embossed, corrugated, or other configurations as disclosed in the above referenced patents and patent applications, depending on the end use application and the performance desired in the appliance insulated according to this invention. However, for most ordinary applications of this invention, smooth individual metal foil layers are preferred from a cost and assembly standpoint.

The fiber insulation utilized in this invention can be any desired and conventional material, such as fiberglass, polyester, aramid, cotton, cellulose, nylon, polyolefin or other fibers. The thickness of the layers of fiber insulation will be the thicknesses conventionally used, although this invention will enable using less fiber insulation, particularly where the metal foil layers used in this invention are multilayer metal foil materials.

It will be apparent from the above disclosure that numerous variations and modifications of the products and methods of this invention of forming of multilayer metal foil preforms to form structural multilayer metal foil shields, as well as numerous designs and configurations of the resulting formed multilayer metal foil shields of this invention, can be practiced by one skilled in the art without departing from the spirit and scope of the present invention. In this regard, it will be recognized that the selection of the materials for the metal foil layers, the selection of the thicknesses of the various layers, the selection of the number of layers of metal foils, the selection of the methods and configurations for providing the gaps between the layers in the desired area, the selection of the fiber and the thickness thereof, etc., are all within the skill of one following teachings of this invention. For example, the multilayer metal foil materials useful in this invention can contain from one to as many layers as is appropriate for the heat or acoustic shielding requirements for a particular appliance application, taking into consideration the economics of the shield product. However, typically one to nine layers of metal foil will be optimum for many appliance applications. Likewise, the thicknesses of the various metal foil layers will vary from 0.0008 in. to 0.006 in., with the 0.002 in. and 0.005 in. metal foils being preferred for many applications. The top sheets or protective sheets used in conjunction with the metal foils can be any desired thickness, which is adaptable to the shaping and forming method of manufacturing the insulation according to this invention. It is preferred that top sheets or protective external sheets usually have a thickness of 0.010 in. up to about 0.050 in. for most normal appliance applications. Some typical examples of layers used in the multilayer metal foil material used in this invention are: (in mils, 1 mil=0.001 in.) 10/2/2/2/5; 5/2/2/2/2/5; 8/2/2/2/4/4/8; 30/4/4/2/2/5; 10/2/2/10; 5/2/2; 10/2/5; 10/2 and 10/2/0.8/0.8/5. One skilled in the art can readily select appropriate combinations of metal foil thicknesses or multilayer metal foil combinations and total thicknesses for specific appliance applications, specific forming processes and configurations and the particular fibers used. The total thickness of the metal foil-fiber insulation will depend not only on the number of layers, the thickness of the layers and the gaps between the layers, but on the shapability and formability of the preform to provide the final desired part. Thickness will range from 0.20 in. to 2.0 in. or greater.

It will also be apparent to one skilled in the art following the above disclosure, that insulation can be made according to this invention without the use of metal foils, i.e., by using metal sheets greater than 0.006 in. in thickness. Examples of such structures would include single layer encapsulating the fiber or multilayer metal structure encapsulating the fiber, such as (in mils.) 10/7; 10/7/10; 20/10/10/10; 30/8/8/8; and the like where the layers are selected to provide appropriate forming and shaping using the methods disclosed herein for multilayer metal sheets to encapsulate the fiber between the layers or between the metal sheet(s) and the appliance wall.

We claim:

1. An insulated appliance comprising:

an enclosure formed in part by wall sections; and at least one wall section having positioned on the exterior surface thereof a fibrous insulation mat;

wherein the opposite side of the fiber insulation mat is adhesively bonded to a multilayer metal foil.

2. An appliance according to claim 1 wherein the appliance is an oven.

3. An appliance according to claim 1 wherein the fiber comprises fiberglass.

4. An appliance according to claim 1 wherein the multilayer metal foil comprises aluminum foil.

5. A method of insulating an appliance comprising:

adhesively bonding a fiber insulating mat to a multilayer metal foil; and positioning the fiber mat on the exterior surface of an appliance enclosure wall whereby the fiber mat is contained in the space between the surface of the enclosure wall and the multilayer metal foil.

6. An appliance according to claim 1 wherein the appliance is a dishwasher.

7. An appliance according to claim 1 wherein the appliance is a refrigerator.

8. An appliance according to claim 1 wherein the fiber comprises polyester fiber.

9. An appliance according to claim 1 wherein the fiber comprises aramid fiber.

10. An appliance according to claim 1 wherein the fiber comprises cellulose fiber.

* * * * *